US008398388B2

(12) United States Patent
Cho et al.

(10) Patent No.: US 8,398,388 B2
(45) Date of Patent: Mar. 19, 2013

(54) VANE PUMP

(75) Inventors: Hang Cheol Cho, Hwaseong-si (KR); Jin Young Hwang, Suwan-si (KR); Seok Jin Kim, Hwaseong-si (KR)

(73) Assignee: Hyundai Motor Company, Seoul (KR)

( * ) Notice: Subject to any disclaimer, the term of this patent is extended or adjusted under 35 U.S.C. 154(b) by 339 days.

(21) Appl. No.: 12/947,065

(22) Filed: Nov. 16, 2010

(65) Prior Publication Data

US 2012/0070328 A1 Mar. 22, 2012

(30) Foreign Application Priority Data

Sep. 17, 2010 (KR) ..... 10-2010-0092061

(51) Int. Cl.

| | |
|---|---|
| ***F01C 1/00*** | (2006.01) |
| ***F03C 2/00*** | (2006.01) |
| ***F03C 4/00*** | (2006.01) |
| ***F04C 2/00*** | (2006.01) |
| ***F04C 18/00*** | (2006.01) |

(52) U.S. Cl. ..... 418/259; 418/243; 418/244; 418/265; 418/266; 418/267; 418/268

(58) Field of Classification Search ..... 418/243, 418/244, 259, 265, 266, 267, 268
See application file for complete search history.

(56) References Cited

U.S. PATENT DOCUMENTS

| | | | | | |
|---|---|---|---|---|---|
| 2,969,935 | A | * | 1/1961 | Price | 244/7 C |
| 3,543,330 | A | * | 12/1970 | Muller | 452/41 |
| 4,484,868 | A | * | 11/1984 | Shibuya et al. | 418/15 |
| 4,505,654 | A | * | 3/1985 | Dean et al. | 418/80 |
| 4,963,080 | A | * | 10/1990 | Hansen | 418/260 |
| 5,069,608 | A | * | 12/1991 | Rather | 418/261 |
| 5,366,361 | A | * | 11/1994 | Mori et al. | 418/261 |

* cited by examiner

*Primary Examiner* — Kenneth Bomberg
*Assistant Examiner* — Dapinder Singh
(74) *Attorney, Agent, or Firm* — Morgan, Lewis & Bockius LLP

(57) ABSTRACT

A vane pump may include an oval fixed portion of which an outer circumference may be oval, a rotation ring that may be rotatably disposed outside of the oval fixed portion with a gap and in which blade slots may be formed in a predetermined depth along a circular interior circumference of the rotation ring at a predetermined interval from each other, blades of which one end thereof may be slidably inserted into the blade slots respectively and of which the other end slidably contacts an outer surface of the oval fixed portion, an elastic member coupled to the rotation ring and elastically pushing the blades towards the oval fixed portion, and a drive portion connected to the rotation ring and rotating the rotation ring such that oil may be sucked through an expanding space that may be formed between at least two of the blades and oil may be pumped through a shrinking space that may be formed between at least two of the blades.

9 Claims, 3 Drawing Sheets

VANE PUMP

CROSS-REFERENCE TO RELATED APPLICATION

The present application claims priority to Korean Patent Application No. 10-2010-0092061 filed in the Korean Intellectual Property Office on Sep. 17, 2010, the entire contents of which are incorporated herein by reference.

BACKGROUND OF THE INVENTION

1. Field of the Invention

The present invention relates to a vane pump that is mounted to various kinds of devices including a transmission and an engine so as to efficiently supply components with oil.

2. Description of Related Art

Due to the high price of oil and CO2 emission problems, there is a high demand to develop environmentally friendly vehicles. Advanced automobile makers have been researching so as to achieve the above objects.

Particularly, transmission efficiency of a gear box of an engine is to be essentially improved so as to reduce fuel consumption, wherein a hydraulic pump is one of main factors of energy loss.

Recently, a vane pump has been applied so as to reduce a load loss of a hydraulic pump, and a chain that is connected to an engine is used to drive the vane pump indirectly.

Meanwhile, when the chain is used to rotate the blades of the vane pump, the noise and vibration is strong, the chain component must be added, and energy is lost during power delivery.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide a vane pump having advantages of reducing energy loss, the number of components, and noise and vibration during power delivery, and efficiently pumping oil.

In aspect of the present invention, the vane pump may include an oval fixed portion of which an outer circumference may be oval, a rotation ring that may be rotatably disposed outside of the oval fixed portion with a gap and in which blade slots may be formed in a predetermined depth along a circular interior circumference of the rotation ring at a predetermined interval from each other, blades of which one end thereof may be slidably inserted into the blade slots respectively and of which the other end slidably contacts an outer surface of the oval fixed portion, an elastic member coupled to the rotation ring and elastically pushing the blades towards the oval fixed portion, and a drive portion connected to the rotation ring and rotating the rotation ring such that oil may be sucked through an expanding space that may be formed between at least two of the blades and oil may be pumped through a shrinking space that may be formed between at least two of the blades.

A shaft hole may be formed through a center portion of the oval fixed portion, and a transmission input shaft may be rotatably disposed through the shaft hole.

The elastic member may be a blade ring of which an interior circumference sequentially pushes the one end of the blades such that the other end of the blades contacts the outer surface of the oval fixed portion, wherein the shape of the blade ring may be elastically transformed to continuously support the blades while the rotation ring may be rotated so as to moves the blades back and forth in the blade slots respectively.

The blades may be disposed with the predetermined interval in a rotating direction of the rotation ring, and when one of the blades may be disposed at a first longest point of the oval fixed portion, which may be the longest point from a center point, a first suction chamber may be formed at one side thereof, and a first supply chamber may be formed at the other side thereof.

One of the blades may be disposed at a second longest point of the oval fixed portion, which may be the longest point from a center point, a second suction chamber may be formed at one side thereof, and a second supply chamber may be formed at the other side thereof.

The drive portion may be a rotation portion of a torque converter of a transmission, and a key that may be formed at one side end portion of the rotation portion may be inserted into one side surface of the rotation ring such that the key rotates the rotation ring.

A blade ring mounting groove may be formed at one side surface of the rotation ring to receive the blade ring therein.

A one-way clutch fixed portion that may be connected to one side of a one-way clutch may be disposed at one side surface of the oval fixed portion.

As stated above, in the vane pump according to the present invention, the rotation ring is rotated not by a chain but by a rotating portion of a torque converter such that the number of components is reduced, the noise and vibration are lessened, and the power delivery efficiency is improved.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

Figure 1:
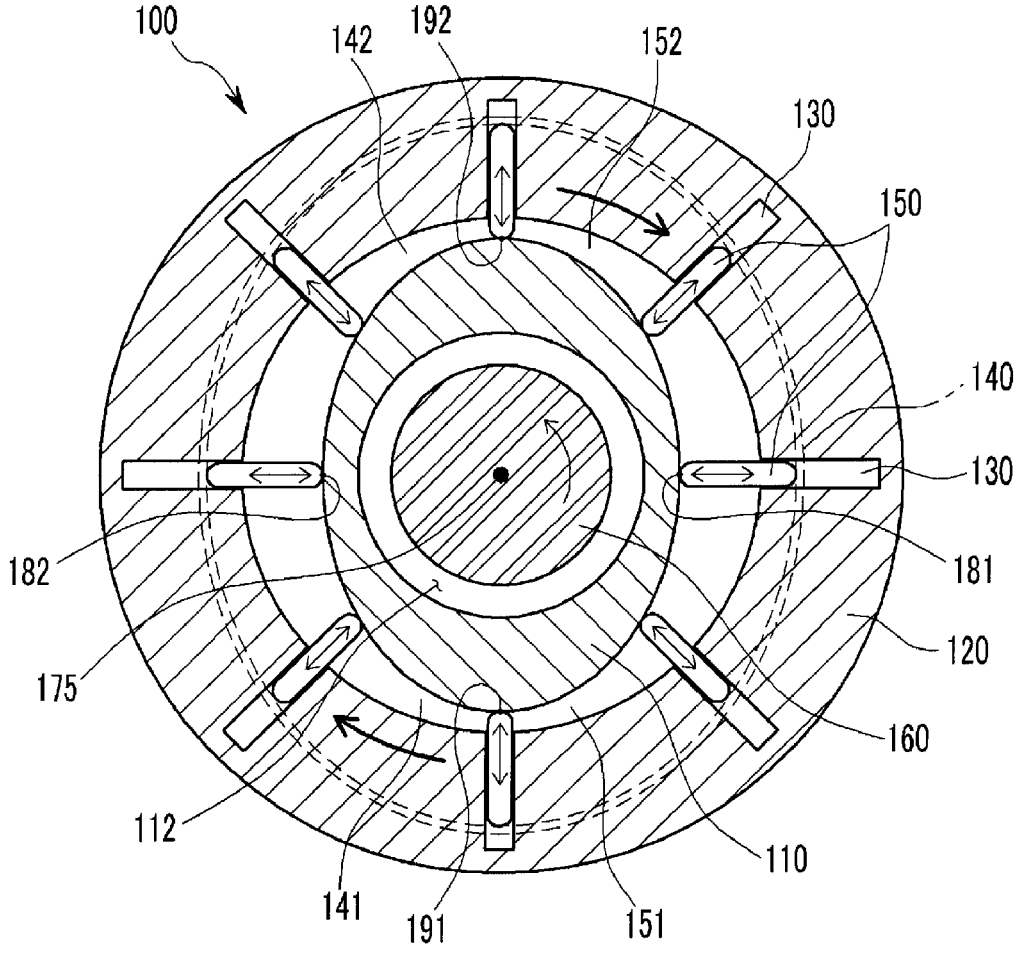
FIG. 1 is a schematic width direction cross-sectional view of a vane pump according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

An exemplary embodiment of the present invention will hereinafter be described in detail with reference to the accompanying drawings.

FIG. 1 is a schematic width direction cross-sectional view of a vane pump according to an exemplary embodiment of the present invention.

Referring to FIG. 1, a vane pump 100 includes a transmission input shaft 160, an oval fixed portion 110, a blade 150, a rotation ring 120, and a blade ring 140.

A section of the oval fixed portion 110 is oval, a shaft hole 112 with a predetermined interior diameter is formed based at a center point in a length direction thereof, and the transmission input shaft 160 is disposed through the shaft hole 112. Here, the center point 175 of the oval fixed portion 110 coincides with a rotation center of the transmission input shaft 160.

A predetermined gap is formed between an exterior circumference of the transmission input shaft 160 and an interior circumference of the shaft hole 112, and the oval fixed portion 110 and the transmission input shaft 160 are separate components.

Accordingly, the oval fixed portion 110 sustains its fixed position, and the transmission input shaft 160 is connected to a crankshaft of an engine to be rotated thereby.

The rotation ring 120 is rotatably disposed at a center point of the oval fixed portion 110, and the rotation ring 120 has a circular interior circumference. Accordingly, the distance between the interior circumference of the rotating ring 120 and the exterior circumference of the oval fixed portion 110 is continuously varied.

Blades slots are formed at the interior circumference of the rotation ring 120, and a length direction center axis of a blade slot 130 heads a center point 175.

One end of the blade 150 is inserted into the blade slot 130, and the other end thereof contacts the outside surface of the oval fixed portion 110.

The rotation ring 120 and the blade 150 rotate together, and the oval fixed portion 110 sustains its fixed position.

While the rotation ring 120 and the blade 150 are being rotated, the other end of blade 150 continuously contacts the outside surface of the oval fixed portion 110.

The interior surface of the blade ring 140 contacts one end portion of the blades 150 to push the blade 150 toward the outside surface of the oval fixed portion 110.

While the rotation ring 120 is being rotated, the blade 150 moves back and forth along the blade slot 130, and the blade ring 140 supports the blade 150 according to the movement of the blade 150.

As shown in FIG. 1, at an oval outer surface of the oval fixed portion 110, the blade 150 is respectively disposed at a first longest point 191, a second longest point 192, a first nearest point 181, and a second nearest point 182.

Further, the blade 150 is respectively disposed between the first longest point 191 and the first nearest point 181, between the first nearest point 181 and the second longest point 192, between the second longest point 192 and the second nearest point 182, and between the second nearest point 182 and the first longest point 191.

In an exemplary embodiment of the present invention, eight blade slots 130 are formed in a rotating direction with a predetermine distance therebetween, and the number can be varied depending on design specifications.

While the rotation ring 120 together with the blade 150 rotates in a clockwise direction, a first supply chamber 151 is formed at the right side of the blade that is positioned at the first longest point 191, and a first suction chamber 141 is formed at the left side.

While a space of the first supply chamber 151 is contracted, the oil thereof is pumped to the outside, and while a space of the first suction chamber 141 is expanded, the oil is sucked from the outside.

Further, a second suction chamber 152 is formed at the right side of the blade 150 that is positioned at the second longest point 192, and a second supply chamber 142 is formed at the left side thereof.

While a space of the second supply chamber 142 is contracted, the oil is pumped to the outside, and while a space of the second suction chamber 152 is expanded, the oil is sucked from the outside.

As described above, the first suction chamber 141 and the first supply chamber 151 are formed around the first longest point 191 of the oval fixed portion 110, and the second suction chamber 152 and the second supply chamber 142 are formed around the second longest point 192.

Figure 2:
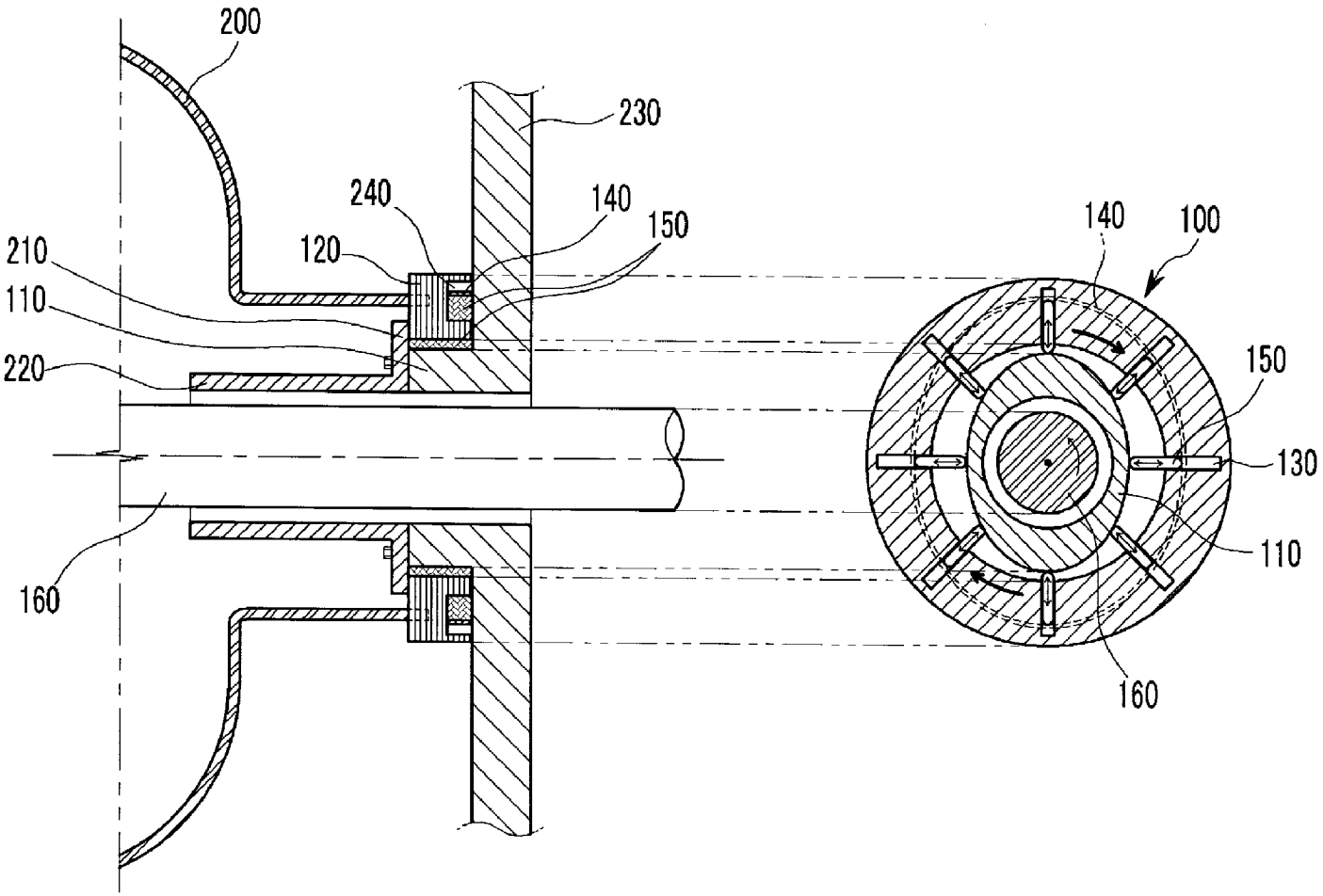
FIG. 2 is a schematic length direction cross-sectional view of a vane pump according to an exemplary embodiment of the present invention.

FIG. 2 is a schematic length direction cross-sectional view of a vane pump according to an exemplary embodiment of the present invention.

The transmission input shaft 160 is disposed at a center portion, and the oval fixed portion 110, the blade 150, the rotation ring 120, and the blade ring 140 are disposed as stated above, referring to FIG. 1.

A blade ring mounting groove 240 is formed at one side surface the rotation ring 120, the blade ring 140 is disposed inside the blade ring mounting groove 240, and the blade ring 140 can move in a center direction of the transmission input shaft 160.

Accordingly, the blade ring 140 moves along the blade ring mounting groove 240 to push the blade 150 towards the outside surface of the oval fixed portion 110.

A pump case 230 is disposed at one surface of the rotation ring 120 and at one side of the oval fixed portion 110, and the pump case 230 is fixed with the oval fixed portion 110 and can slide with one side surface of the rotation ring 120.

Further, a sealing portion 210 is fixedly disposed at the other side surface of the oval fixed portion 110, and a one-way clutch fixed portion 220 is extended from the sealing portion 210 in a length direction of the transmission input shaft 160. The torque converter one-way clutch fixed portion 220 is formed around the transmission input shaft 160 along the outer circumference to be connected to one fixation portion one-way clutch.

A rotation drive portion 200 is a rotation part of a torque convertor, and one side end portion of the rotation drive portion 200 is inserted into the other side surface of the rotating ring 120 to rotate the rotating ring 120.

Figure 3:
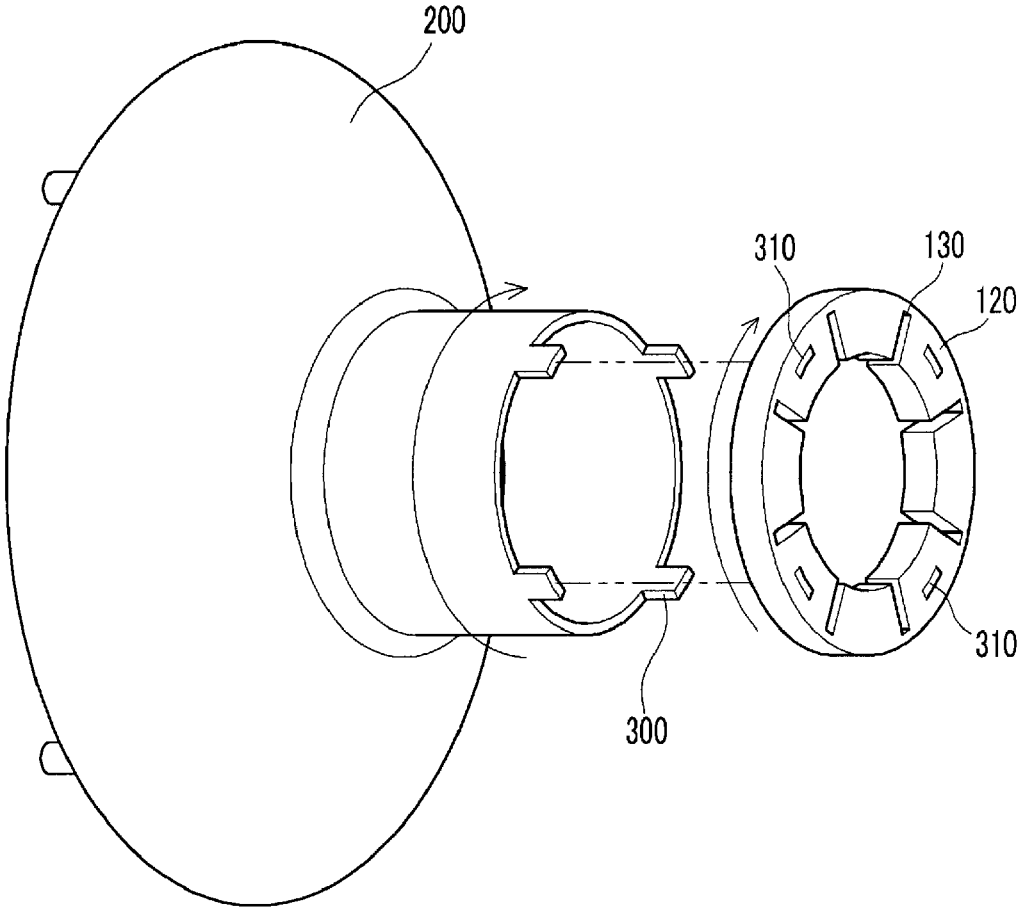
FIG. 3 is a partial exploded perspective view of a vane pump according to an exemplary embodiment of the present invention.

FIG. 3 is a partial exploded perspective view of a vane pump according to an exemplary embodiment of the present invention.

Referring to FIG. 3, a key groove 310 is formed at the rotation ring 120 in a rotating direction, and a key 300 having a protrusion and depression shape is formed at end portion of the rotation drive portion 200 corresponding to the key groove 310.

Accordingly, the rotation ring 120 is rotated by the key 300 of the rotation drive portion 200.

As described above, the rotation ring 120 of the vane pump is not driven by a chain but by the rotation drive portion 200 of a torque converter directly connected to the engine such that the number of components is reduced, the noise and vibration are reduced, and the power delivery efficiency is improved.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A vane pump, comprising:

an oval fixed portion of which an outer circumference is oval;

a rotation ring that is rotatably disposed outside of the oval fixed portion with a gap and in which blade slots are formed in a predetermined depth along a circular interior circumference of the rotation ring at a predetermined interval from each other;

blades of which one end thereof is slidably inserted into the blade slots respectively and of which the other end slidably contacts an outer surface of the oval fixed portion;

an elastic member coupled to the rotation ring and elastically pushing the blades towards the oval fixed portion; and a drive portion connected to the rotation ring and rotating the rotation ring such that oil is sucked through an expanding space that is formed between at least two of the blades and oil is pumped through a shrinking space that is formed between at least two of the blades.

2. The vane pump of claim 1, wherein a shaft hole is formed through a center portion of the oval fixed portion, and a transmission input shaft is rotatably disposed through the shaft hole.

3. The vane pump of claim 1, wherein the elastic member is a blade ring of which an interior circumference sequentially pushes the one end of the blades such that the other end of the blades contacts the outer surface of the oval fixed portion.

4. The vane pump of claim 3, wherein the shape of the blade ring is elastically transformed to continuously support the blades while the rotation ring is rotated so as to moves the blades back and forth in the blade slots respectively.

5. The vane pump of claim 3, wherein the blades are disposed with the predetermined interval in a rotating direction of the rotation ring, and when one of the blades is disposed at a first longest point of the oval fixed portion, which is the longest point from a center point, a first suction chamber is formed at one side thereof, and a first supply chamber is formed at the other side thereof.

6. The vane pump of claim 5, wherein one of the blades is disposed at a second longest point of the oval fixed portion, which is the longest point from a center point, a second suction chamber is formed at one side thereof, and a second supply chamber is formed at the other side thereof.

7. The vane pump of claim 1, wherein the drive portion is a rotation portion of a torque converter of a transmission, and a key that is formed at one side end portion of the rotation portion is inserted into one side surface of the rotation ring such that the key rotates the rotation ring.

8. The vane pump of claim 3, wherein a blade ring mounting groove is formed at one side surface of the rotation ring to receive the blade ring therein.

9. The vane pump of claim 1, wherein a one-way clutch fixed portion that is connected to one side of a one-way clutch is disposed at one side surface of the oval fixed portion.

* * * * *